US007318680B2

(12) United States Patent
Sugimoto et al.

(10) Patent No.: US 7,318,680 B2
(45) Date of Patent: Jan. 15, 2008

(54) LABEL PRINTER AND PRINTING MEDIUM

(75) Inventors: Kiyoshi Sugimoto, Kuwana (JP); Keiji Seo, Nagoya (JP); Atsushi Kasugai, Nagoya (JP); Akira Sago, Seto (JP); Terumasa Hoshino, Nagoya (JP); Haruki Matsumoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 225 days.

(21) Appl. No.: 10/986,827

(22) Filed: Nov. 15, 2004

(65) Prior Publication Data

US 2005/0147452 A1 Jul. 7, 2005

(30) Foreign Application Priority Data

Jan. 6, 2004 (JP) ..... 2004-001038
Jan. 6, 2004 (JP) ..... 2004-001039

(51) Int. Cl.
*B41J 15/02* (2006.01)
*B41J 29/00* (2006.01)

(52) U.S. Cl. ..... 400/613; 400/693; 283/62; 283/81

(58) Field of Classification Search ..... None
See application file for complete search history.

(56) References Cited

U.S. PATENT DOCUMENTS 5,442,188 A * 8/1995 Brimbal et al. ..... 250/566
6,934,043 B1 * 8/2005 Sugiyama et al. ..... 358/1.15
2004/0112961 A1 * 6/2004 Asano ..... 235/432
2005/0036819 A1 * 2/2005 Monteith et al. ..... 400/615.2

FOREIGN PATENT DOCUMENTS

JP 62016333 A * 1/1987
JP U 62-113577 7/1987
JP U 62-153252 9/1987
JP U 3-19047 2/1991
JP 09016085 A * 1/1997
JP 2000168181 A * 6/2000

OTHER PUBLICATIONS

Machine translation of JP 2000168181 to Murata from Japanese Patent Office website.*
Machine translation of JP 09016085 to Ito from Japanese Patent Office website.*

* cited by examiner

*Primary Examiner*—Daniel J. Colilla
(74) *Attorney, Agent, or Firm*—Oliff & Berridge, PLC

(57) ABSTRACT

In a label printer, a top cover made of transparent resin is attached to a housing at a rear upper edge to cover a roll sheet holder storage part and to be freely opened and closed. A roll sheet of a roll sheet holder removably mounted in the roll sheet holder storage part is visible through the transparent resinous top cover. The roll sheet is provided with a plurality of medium information marks by printing. The medium information marks are visible through the top cover.

12 Claims, 17 Drawing Sheets

3
20
44
45
36
40
43
42
60
48
35
47
37
55
12
13
56
57
12A
62
43A
43B
43C
10m
20m
30m
Y
Z

LABEL PRINTER AND PRINTING MEDIUM

BACKGROUND OF THE INVENTION

1. Field of the Invention

The present invention relates to a label printer provided with a cover which is opened and closed for setting and replacing of a printing medium and relates to a printing medium to be used in the label printer.

Further, the present invention relates to a label printer adapted to receive a printed label discharged from the label printer.

2. Description of Related Art

One of conventional printers using a long printing medium is adapted to set a roll sheet in a main body of the printer. To set the roll sheet in the main body, a cover attached to the main body is first opened, exposing a storage part. Then, the roll sheet is set in the storage part and the cover is closed. Such printer is for example disclosed in Japanese utility model application laid-open No. H3-19047 (1991-19047).

When the cover is closed, the setting work of the roll sheet is finished. At this time, however, a user cannot see the roll sheet from outside.

In the case of producing a receipt, for example, a user can find that a roll sheet set in the printer is getting low by seeing the color and mark applied on part of the roll sheet discharged from the printer even if the roll sheet set in the printer is invisible from outside. Further, there is little necessity to use another roll sheet having a different width as a receipt and the user would hardly check a specification (width, length, etc.) of the roll sheet in particular.

On the other hand, in cases of printing on a label made of a heat-sensitive sheet and a release sheet bonded thereon with an adhesive, a roll sheet for the label is often changed to another roll sheet of a different width. Accordingly, even where the cover is in a closed state, it is necessary for the user to check afterward the specification (width, length, etc.) of the roll sheet.

Differently from a cassette type roll sheet, the roll sheet has no cover or the like for affixing a seal or the like which is indicating the specification.

In such a case, accordingly, the user cannot see the roll sheet from outside after closing the cover even if he wishes to check afterward the specification (width, length, etc.) of the roll sheet. Even where the cover is in an opened state, the user cannot confirm the specification of the roll sheet because the roll sheet has no part applied with the specification.

Moreover, many conventional printers have a discharge tray which receives paper sheets discharged. One of such printers is disclosed in for example Japanese utility model application laid-open No. S62-153252 (1987-153252).

When a paper sheet is discharged with a printed surface facing downward, the discharge tray receives the sheet of which the printed surface facing down as just discharged. In this state, a user could not see or confirm a printed content.

Such printer usually prints on the undersurface of a paper sheet being fed or conveyed within the printer. In this view, the printer has to include a mechanism for inverting the sheet during feeding in order to allow a user to see the printed content on the sheet received in the discharge tray.

However, among the printers, a label printer which produces a printed label is entirely small in size and hence it does not have a sufficient space for an additional mechanism. Providing such additional mechanism will lead to not only a large-size label printer but also complication of mechanisms, high cost, and other disadvantages.

SUMMARY OF THE INVENTION

The present invention has been made in view of the above circumstances and has an object to overcome the above problems and to provide a label printer which allows a user to see a specification of a printing roll medium set in the label printer and provide a printing medium to be used in the label printer.

Further, the present invention has another object to provide a label printer which allows a user to see a printed surface of a produced label facing downward to be discharged from the printer, without growing in size, and becoming complicated in mechanisms and higher in cost.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a label printer comprising: a housing in which a rolled printing medium is mounted so that one edge of the printing medium is aligned with one side of the housing, the printing medium having a printing surface and a back surface on which a medium information mark previously is provided, and the printing medium being wound so that the printing surface is inside and the medium information mark appears outside; and a top cover placed over the housing, the top cover being entirely or partially made of a transparent material so that the medium information mark is visible therethrough.

The above printing medium is wound into a roll in such a manner that the printing surface comes to the inside of the printing medium. On the back of the printing surface, there is the medium information mark previously provided, which comes to the outside of the printing medium. The above label printer is adapted such that the printing medium is mounted in the housing (main body). This printing medium is covered by the top cover placed over the housing. The top cover covering the printing medium is partially or entirely made of a transparent material, so that the medium information mark appearing on the outside of the printing medium is visible from outside through the top cover. Accordingly, the label printer of the present invention allows a user to see the medium information mark from outside even when the printing medium is mounted in the label printer.

According to the present invention, in the case where the printing medium is mounted in the housing of the label printer at a position so that one edge of the printing medium is aligned with the one side of the housing, it is preferably to use the printing medium previously provided with the medium information mark on the edge portion adjacent to the referential one side of the housing as the printing medium to be mounted in the housing. Even when the specification (width, etc.) of the printing medium is changed, the medium information mark of the printing medium is always in the same position in the housing. This makes it possible to easily see the medium information mark from outside. While making sure of visibility to the medium information mark from outside, the top cover provided over the housing may be made of a transparent material only in a selected part.

According to another aspect of the invention, a printing medium including: a printing surface; and a back surface on which medium information mark is previously provided; wherein the printing medium is wound so that the printing surface is inside and the medium information mark appears outside, and the printing medium is mountable in a label printer comprising: a housing in which the printing medium is mounted so that one edge of the printing medium is aligned with one side of the housing; and a top cover placed over the housing, the top cover being entirely or partially made of a transparent material so that the medium information mark is visible therethrough.

The above printing medium is wound into a roll in such a manner that the printing surface comes to the inside of the printing medium. On the back of the printing surface, there is the medium information mark previously provided, which appears on the outside of the printing medium. The above label printer is adapted such that the printing medium is mounted in the housing. This printing medium is covered by the top cover provided to the housing. The top cover covering the printing medium is partially or entirely made of a transparent material, so that the medium information mark appearing on the outside of the printing medium is visible from outside through the top cover. Accordingly, the label printer of the present invention allows a user to see the medium information mark from outside even when the printing medium is mounted in the label printer.

Further, according to another aspect of the invention, a label printer comprising a housing and a top cover placed over the housing, adapted to discharge a printed label with a printed surface facing downward through a clearance between the housing and the top cover, wherein the label printer further includes a guide member vertically provided in the housing for receiving the printed label which is discharged while sliding on the guide member, with the printed surface being in contact with the guide member, into a vertical state where the printed surface is visible.

In the above label printer, the top cover is placed over the housing provided with the guide member in a standing position. The printed label is thus discharged with the printed surface facing downward through a clearance between the housing and the top cover. At this time, the printed label is allowed to slide on the guide member so that the printed surface is in contact with the guide member. The printed label is discharged into a vertical state where the printed surface thereof is made visible. Thus, the printed surface of the printed label discharged with the printed surface facing downward can be confirmed. Further, the guide member whereby the printed surface of the printed label is brought into a visible state is simply in a standing position, which needs no special space and a complicated structure, and can sufficiently be made of a low-cost structure. Accordingly, the label printer can be achieved without growing in size, and becoming complicated in mechanisms and higher in cost.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a label printer and a roll sheet holder embodying the present invention will now be given referring to the accompanying drawings.

First Embodiment

A schematic structure of a label printer in the present embodiment is first explained with reference to FIGS. 1 to 7.

Figure 1:
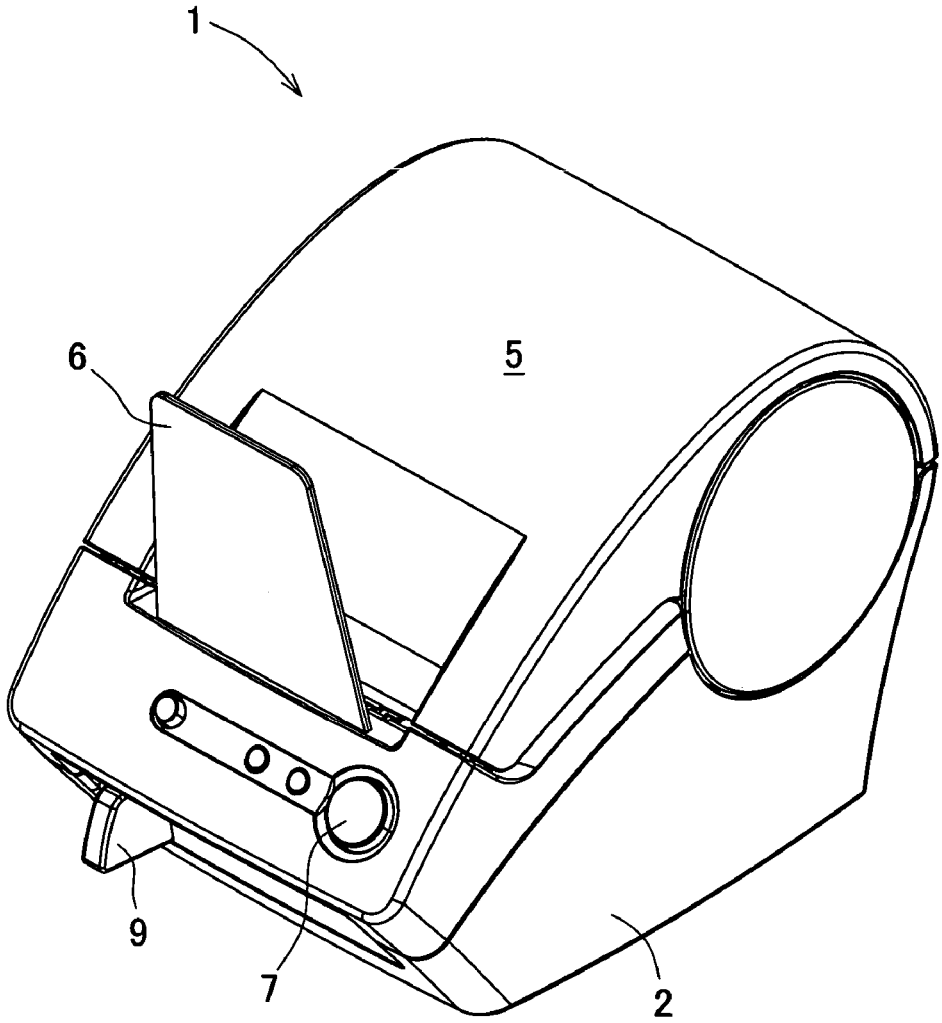
FIG. 1 is a schematic perspective view of a label printer in a first embodiment.
Figure 2:
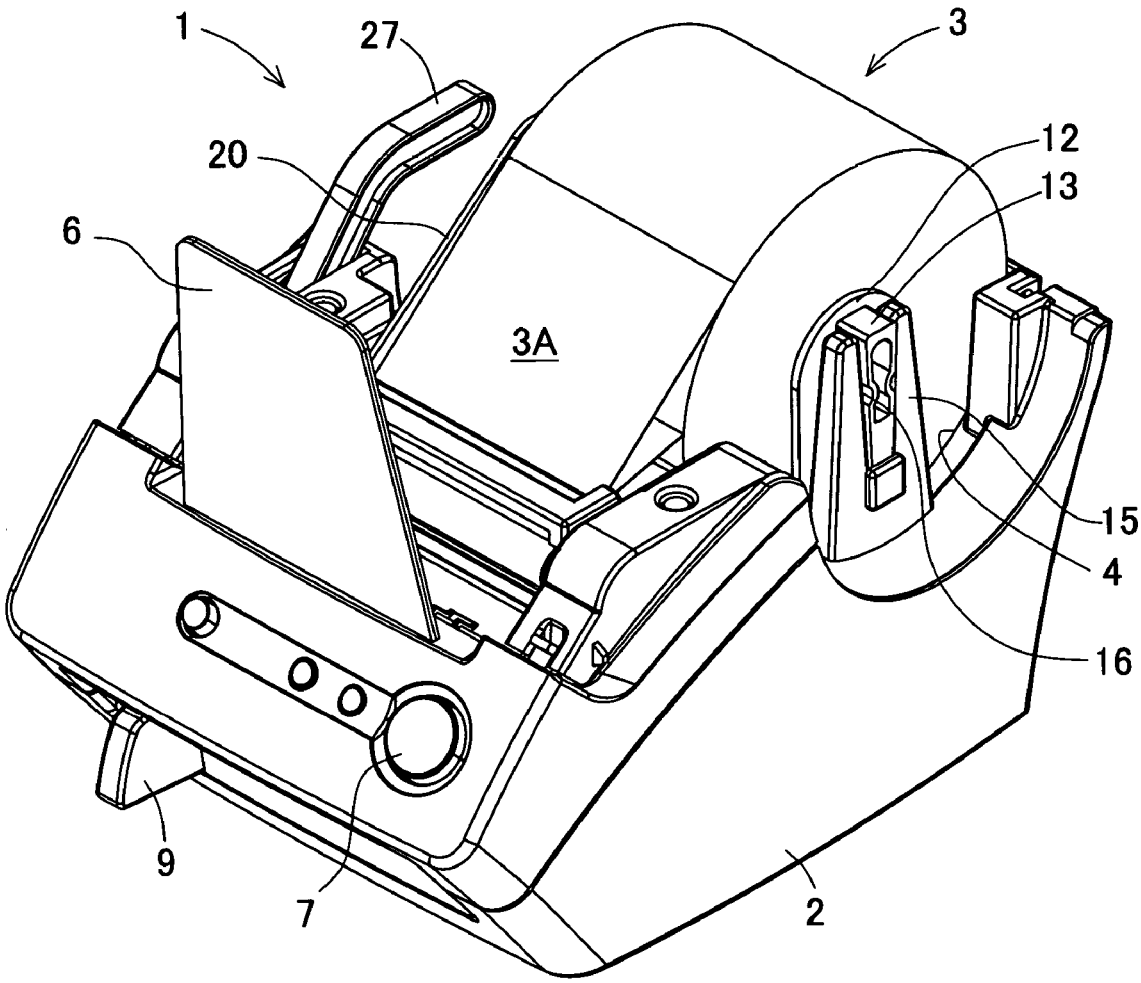
FIG. 2 is a perspective view of the label printer of which a top cover is removed, in which a roll sheet holder holding a roll sheet of a maximum width is mounted.
Figure 3:
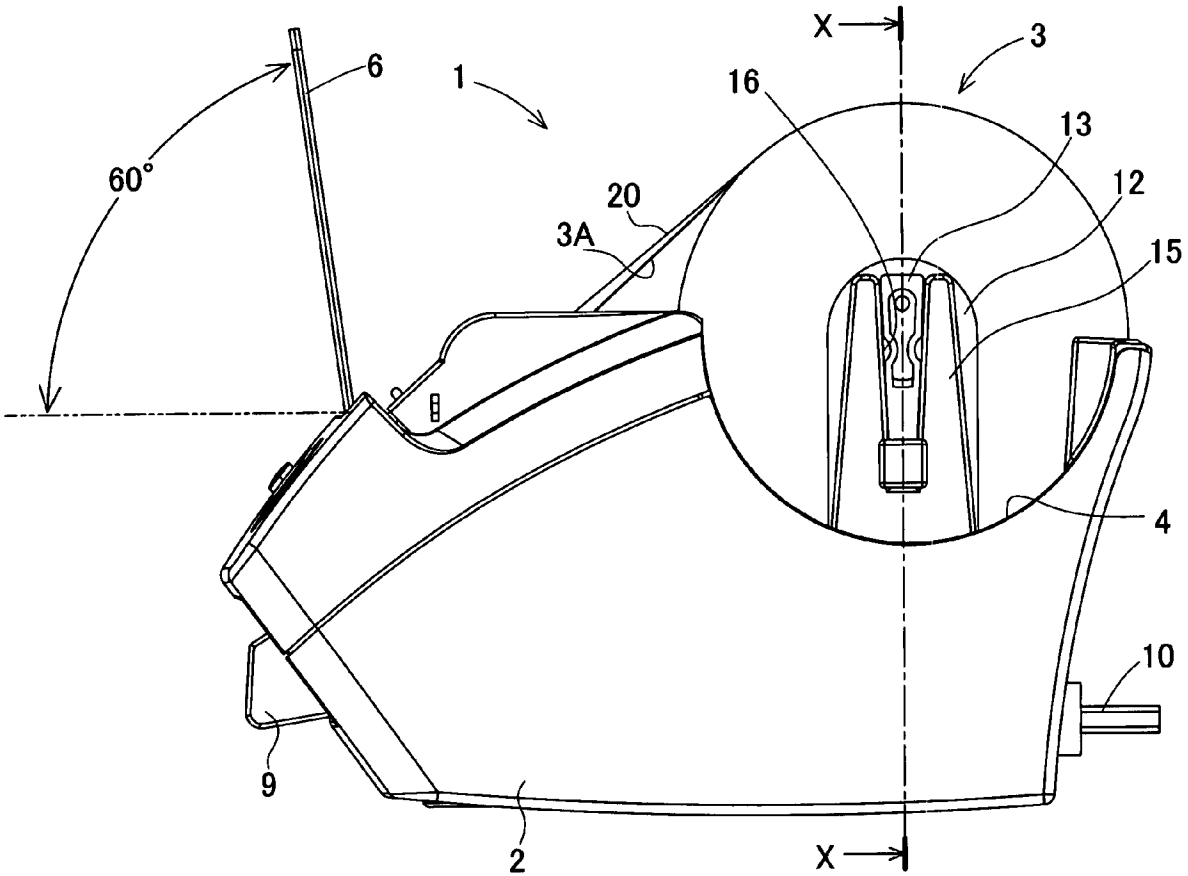
FIG. 3 is a side view of the label printer of FIG. 2.

As shown in FIGS. 1 to 3, a label printer 1 includes a housing (main body) 2, a top cover 5 made of transparent resin attached to the housing 2 at a rear upper edge, a tray 6 made of transparent resin disposed in a standing position to face a substantially front center of the top cover 5, a power button 7 placed in front of the tray 6, a cutter lever 9 provided in a front face of the housing 2, and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width. The cutter lever 9 is movable side to side to horizontally move a cutter unit 8 (see FIG. 7). A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The roll sheet 3A is formed of a long thermal sheet (so-called "thermal paper") having a self color development property or a long label sheet formed of the thermal sheet whose one surface is bonded with a release sheet with an adhesive. The roll sheet 3A is in a wound state around a hollow cylindrical sheet core 3B (see FIG. 4).

Figure 4:
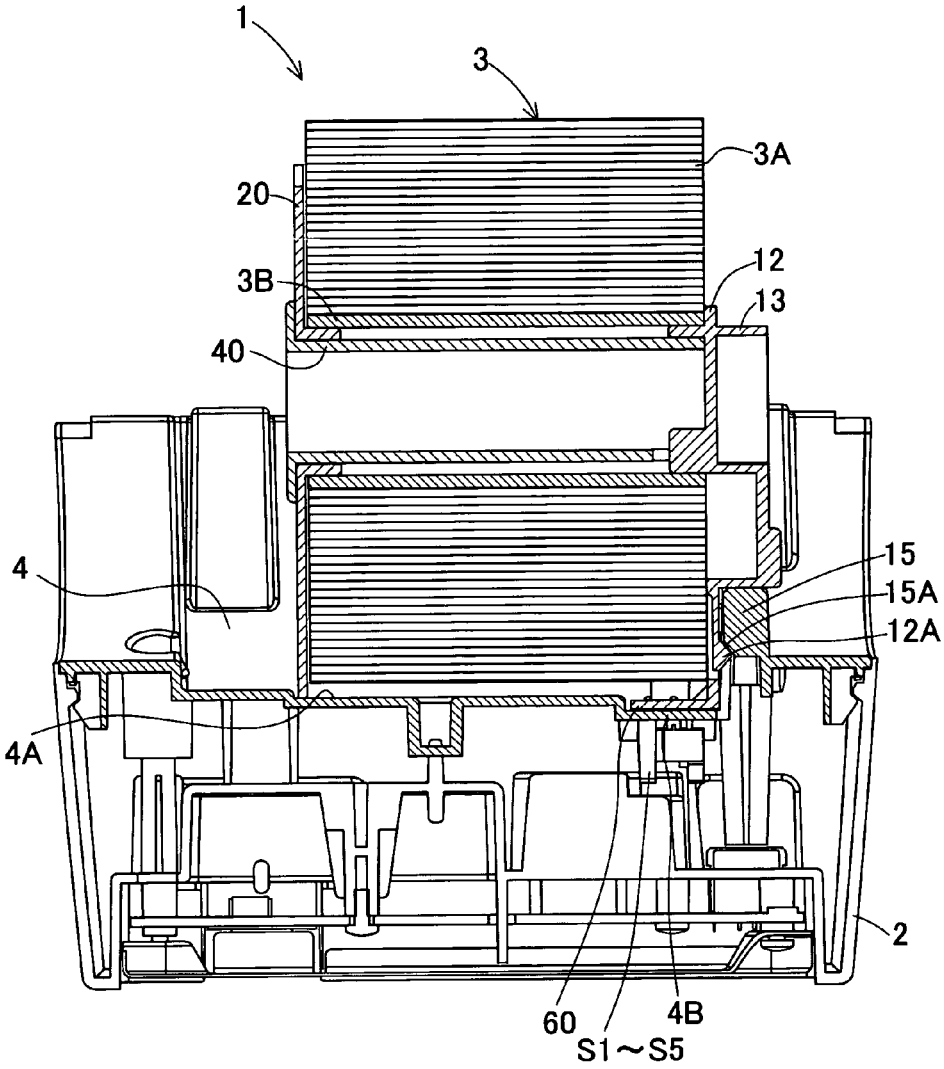
FIG. 4 is a sectional view taken along a line X-X in FIG. 3.
Figure 5:
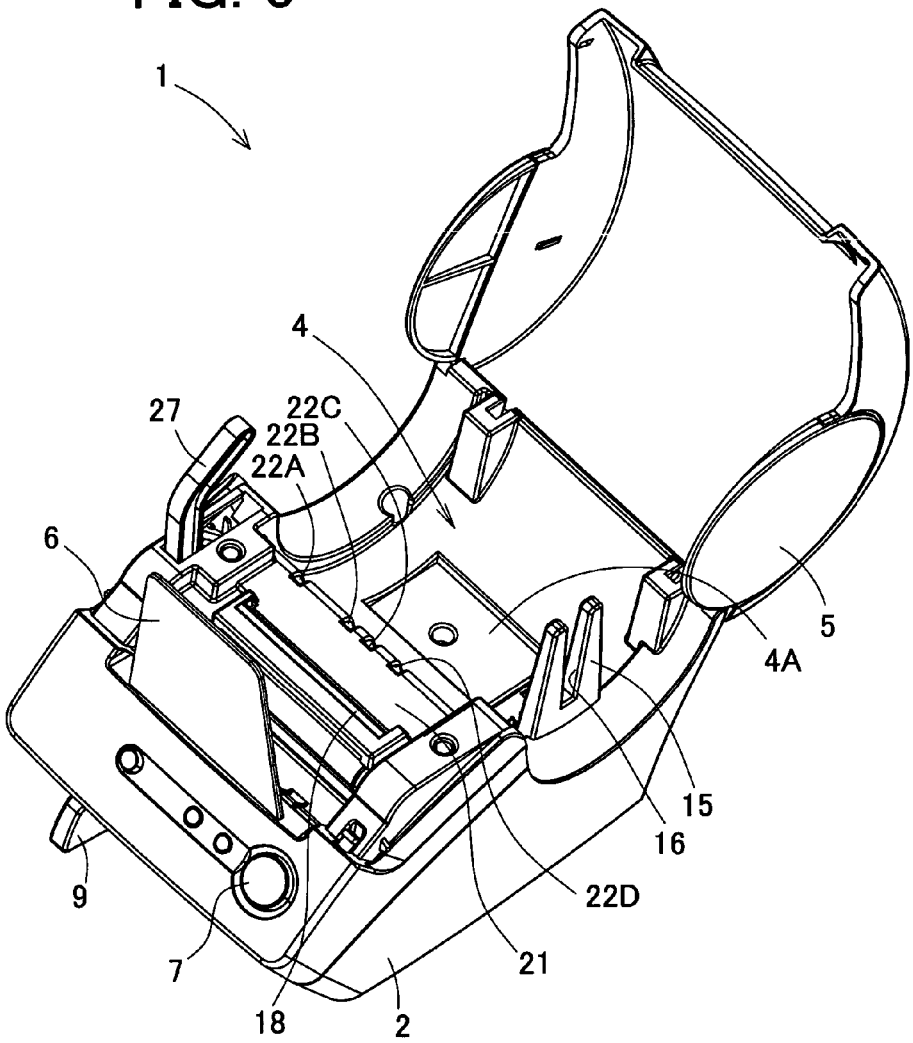
FIG. 5 is a schematic perspective view of the label printer in the first embodiment, from which the top cover is opened.
Figure 6:
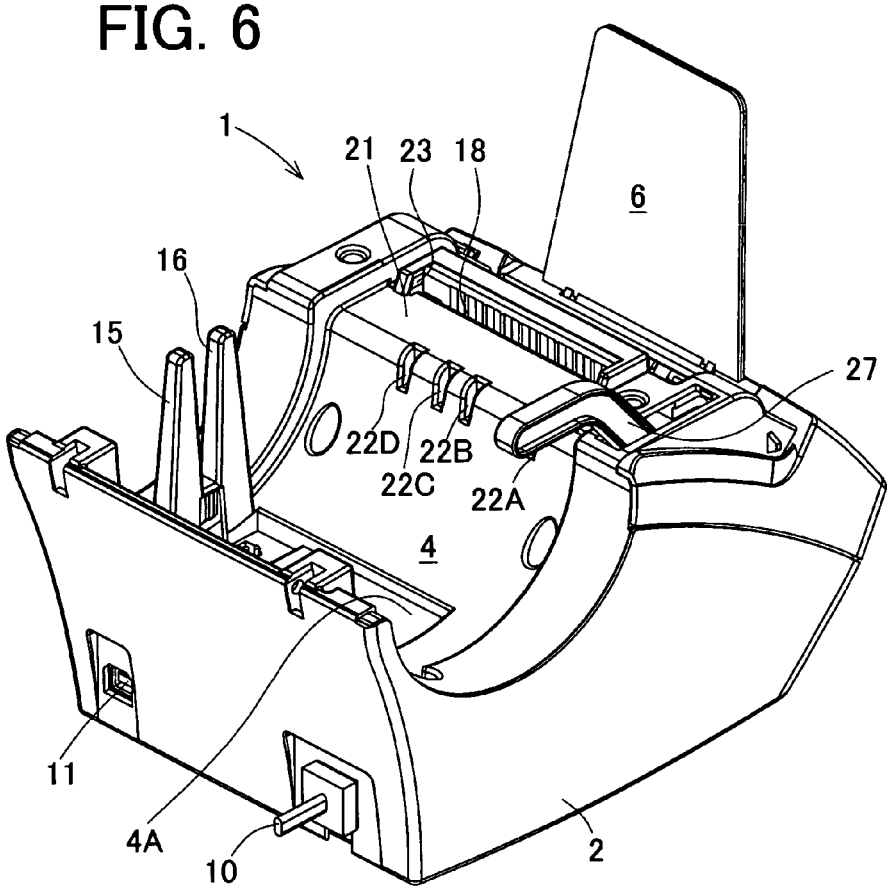
FIG. 6 is a schematic perspective back view of the label printer in the first embodiment, from which the top cover is removed.

In this view, the roll sheet 3A is in a wound state around a hollow cylindrical sheet core 3B in such a manner the thermal sheet is inside (see FIG. 4). Accordingly, the release sheet bonded on one surface of the thermal sheet with an adhesive is wound comes to the outside.

As shown in FIG. 3, the tray 6 is provided to stand vertically at an angle of about 60° with respect to a plane, indicated by a chain double-dashed line, parallel to a plane on which the label printer 1 is placed. The angle between the tray 6 and the plane parallel to the plane on which the label printer 1 is placed may be determined in a range of 60° to 90°.

The tray 6 may be made of a U-shaped metallic wire, instead of the transparent resin.

As shown in FIGS. 2 through 6, the label printer 1 is provided with a holder support member 15 in the holder storage part 4 at a side end (a left side end in FIG. 6) in a substantially perpendicular direction to a sheet feeding direction. The holder support member 15 receives a mounting piece (a positioning rib) 13 of a positioning holding member (hereinafter, a "holding member") 12 constructing the roll sheet holder 3 mentioned later. The mounting piece 13 is provided protruding in a substantially longitudinal rectangular shape on the outer surface of the holding member 12. Specifically, the holder support member 15 is shaped like an angled U-shape as seen in side view of the printer 1, providing a first positioning groove 16 which opens upward and toward both side surfaces of the holder support member 15 in a direction of the width of the tape printer 1. The holder support member 15 is also formed with a recess 15A which engages an elastic locking piece 12A formed projecting at a lower end of the holding member 12.

Figure 7:
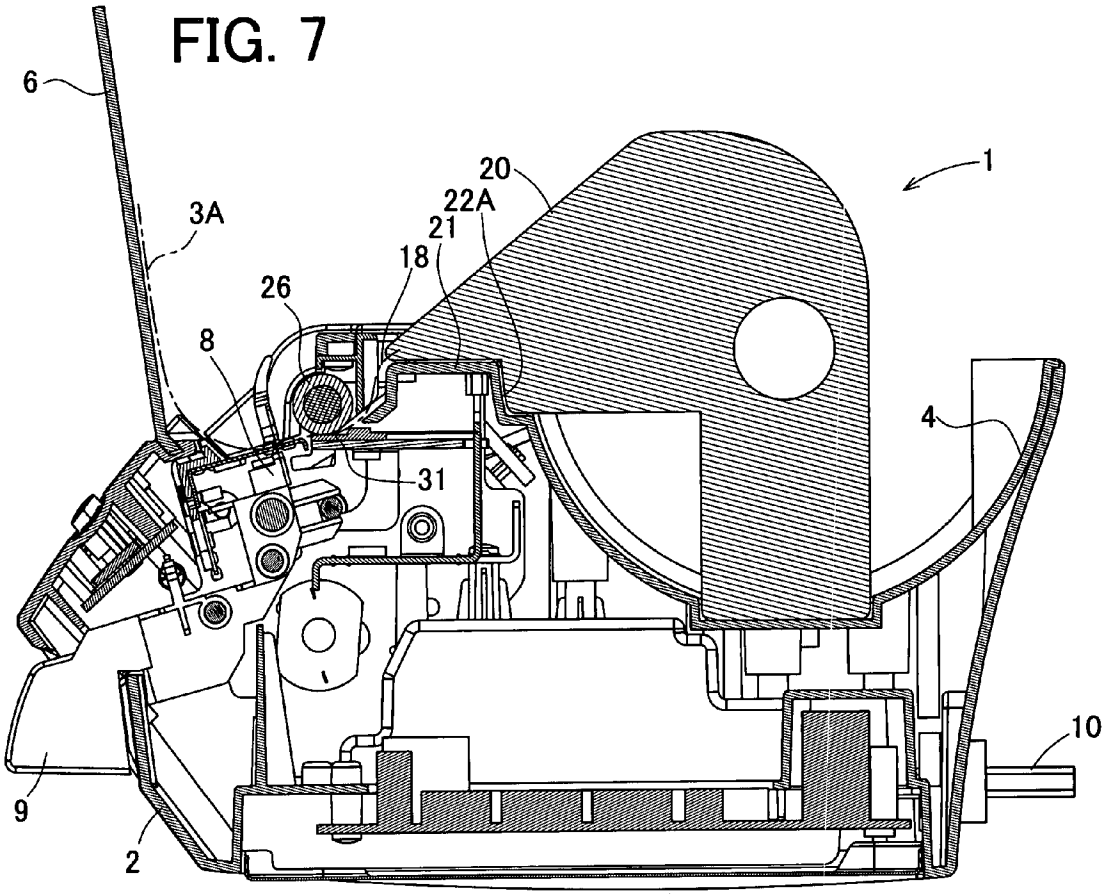
FIG. 7 is a sectional side view of the label printer in the first embodiment, showing a state where the roll sheet holder is mounted and the top cover is removed.

The housing 2 is formed with an insertion opening 18 through which a leading end of an unwound part of the roll sheet 3A is inserted into the housing 2. A flat portion 21 is formed substantially horizontal between a rear end (in the feeding direction) of the slot 18 and a front upper edge portion of the holder storage part 4. On this flat portion 21, a front end portion of a guide member 20 of the roll sheet holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of roll sheets 3A of different widths. Each of the second positioning grooves 22A to 22D is configured to fittingly receive a front part of the guide member 20 inserted from above, as shown in FIG. 7. Further, the front end of the guide member 20 of the roll sheet holder 3 extends to the insertion opening 18.

Figures 10A, 10B, 10C:
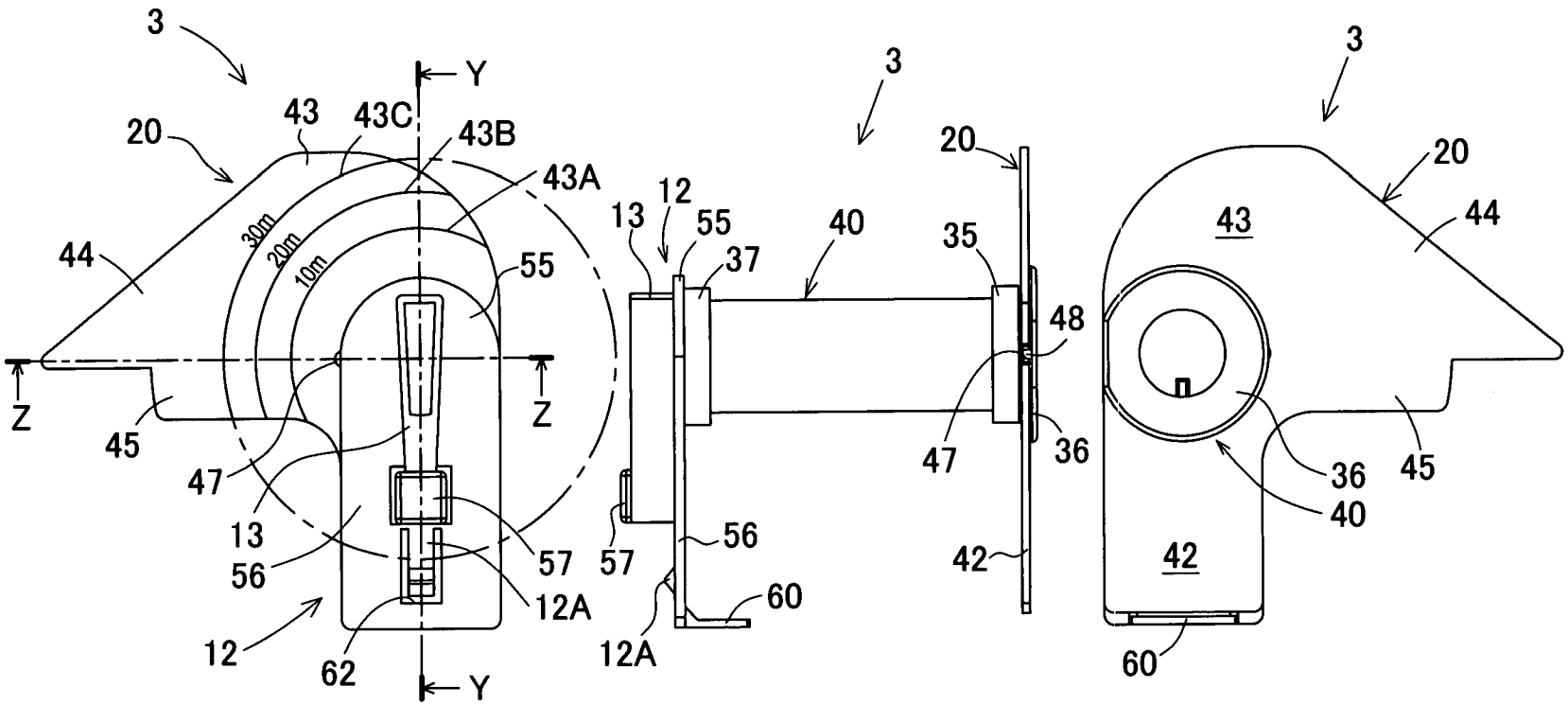
FIG. 10A is a side view of the roll sheet holder in the first embodiment, seen from left of the roll sheet holder in FIG. 10B.
FIG. 10B is a back view of the roll sheet holder in the first embodiment.
FIG. 10C is a side view of the roll sheet holder in the first embodiment, seen from right of the roll sheet holder in FIG. 10B.
Figure 11:
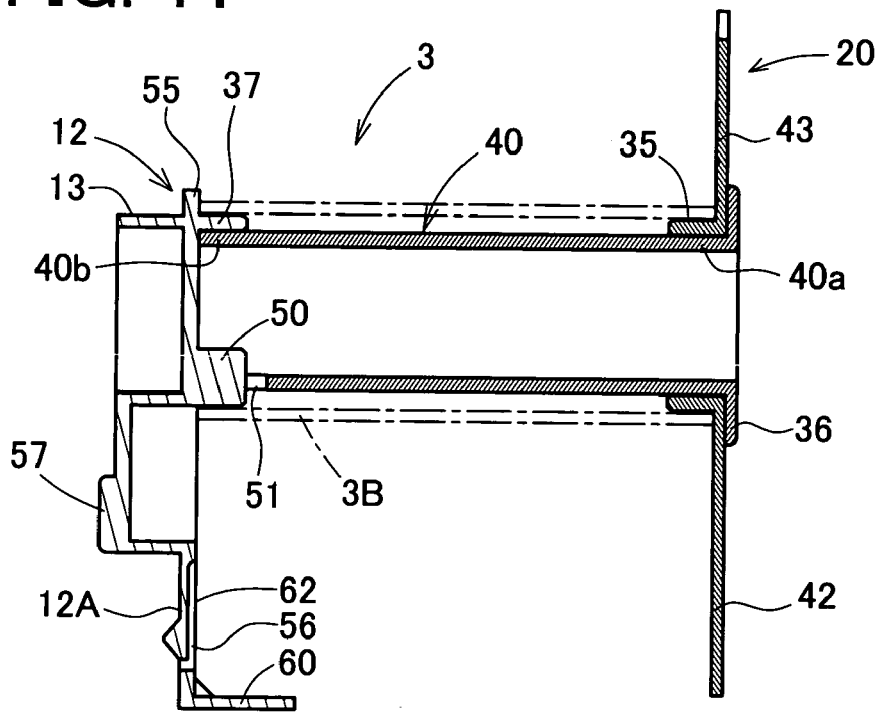
FIG. 11 is a sectional view of the roll sheet holder taken along a line Y-Y in FIG. 10A.
Figure 12:
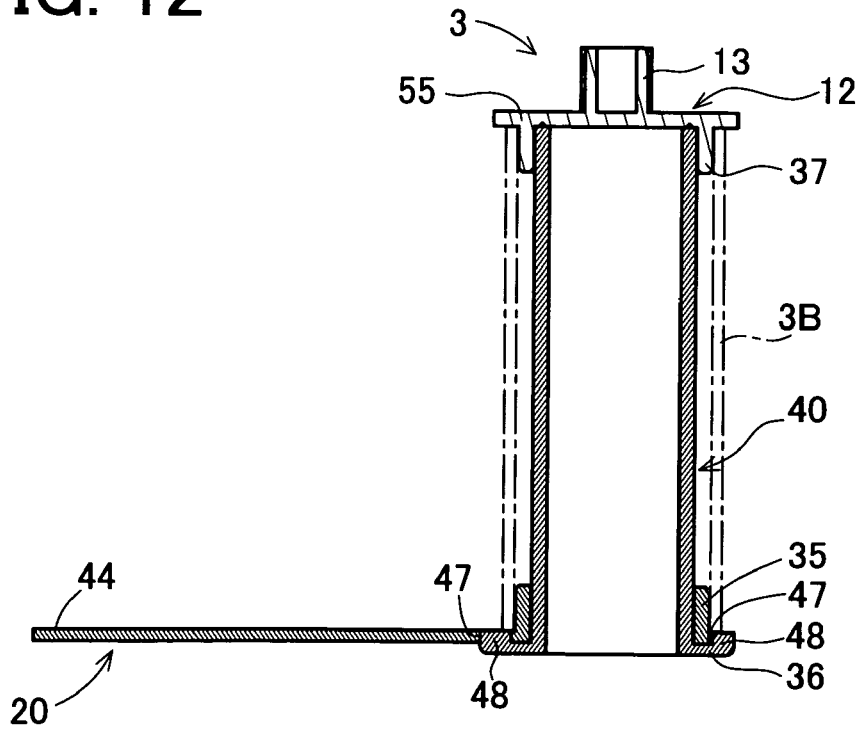
FIG. 12 is a sectional view of the roll sheet holder taken along a line Z-Z in FIG. 10A.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the first embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the first embodiment) than the positioning recess 4A. The discrimination recess 4B will receive a sheet discrimination part 60 (see FIG. 10) mentioned later which extends inward from the lower end of the holding member 12 at a right angle therewith. In the discrimination recess 4B, there are provided five sheet discrimination sensors S1, S2, S3, S4, and S5 arranged in an L-shaped pattern for distinguishing the kind (e.g., width) of the roll sheet 3A. These sensors S1 to S5 are each constructed of a push type microswitch or the like, specifically, a well known mechanical switch including a plunger and a microswitch. It is detected whether the sheet discrimination part 60 has sensor holes (through holes) 60A to 60E (see FIG. 8B), mentioned later, at the positions corresponding to the sheet discrimination sensors S1 to S5 respectively. Based on an ON/OFF signal representing a detection result by the sensors S1 to S5, the kind of the roll sheet 3A set in the roll sheet holder 3 is detected. In the first embodiment, the tape discrimination sensors S1 to S5 are allowed to normally protrude from the bottom surface of the discrimination recess 4B to near the bottom surface of the positioning recess 4A, that is, at the height substantially corresponding to a depth difference between the discrimination recess 4B and the positioning recess 4A. At this time, each microswitch is in an OFF state.

In the case where the sheet discrimination part 60 has some sensor hole(s) 60A to 60E at the positions corresponding to the sheet discrimination sensors S1 to S5, the plunger(s) of the sensor(s) for which the sheet discrimination part 60 has sensor hole(s) is allowed to pass through the associated sensor holes 60A to 60E without depression, leaving the corresponding microswitch(es) in the OFF state, which generates an OFF signal.

On the other hand, the plunger(s) of the sensor(s) for which the sheet discrimination part 60 has no sensor hole(s) is depressed, bringing the corresponding microswitch(es) into the ON state, which generates an ON signal.

The insertion opening 18 is arranged so that its one side end (a left end in FIG. 6) on the holder support member 15 side is positioned substantially in one plane with the inner surface of the holder support member 15 in which the positioning groove 16 opens, more properly, in one plane with the inner surface of the positioning member 12 when engaged in the holder support member 15. In the insertion opening 18, a guide rib 23 is formed on the side end near the holder support member 15.

A lever 27 for operating the vertical movement of a thermal head (see FIG. 7) is provided in front of the other side end (a left end in FIG. 5) of the holder storage part 4 in the feeding direction. To be more specific, when the lever 27 is turned up, the thermal head 31 is moved down and separated from a platen roller 26 (see FIG. 7). When the lever 27 is turned down, to the contrary, the thermal head 31 is moved up, thereby pressing the unwound part of the roll sheet 3A against the platen roller 26. A printable condition is thus developed. Further, below the roll sheet holder 4, there is provided a control board 32 on which a control circuit is formed to drive and control each mechanism in response to commands from an external personal computer and others.

The roll sheet holder 3 in which the roll sheet 3A wound on the sheet core 3B is removably mounted in the holder storage part 4 in the following manner. The mounting piece 13 of the positioning member 12 is inserted from above into the first positioning groove 16 of the holder support member 15. The elastic locking piece 12A formed projecting at the lower end of the positioning member 12 is then engaged in the locking recess 15A formed in the inner base end of the holder support member 15. A front lower portion (i.e., a fourth extended portion 45 mentioned later) of the guide member 20 is engaged in appropriate one of the second positioning grooves 22A to 22D and the lower end portion of the guide member 20 is fittingly inserted in the positioning recess 4A. Then, a user (operator) moves the lever 27 up and inserts a leading end of an unwound part of the roll sheet 3A into the insertion opening 18 while keeping one side edge of the unwound part of the roll sheet 3A in contact with the inner surface of the guide member 20 and the other side edge in contact with the guide rib 23 provided at the side end of the insertion opening 18. Thereafter, the user moves the lever 27 down. Printing is thus enabled.

As shown in FIG. 7, when the lever 27 is moved down, the part of the roll sheet 3A inserted in the insertion opening 18 is pressed against the platen roller 26 by means of the thermal head 31 of a line type. The platen roller 26 is driven to rotate by a step motor or the like not shown while the thermal head 31 is drivingly controlled to print image data on a printing surface of the roll sheet 3A which is fed sequentially. This printing is made on the printing surface which faces downward and is pressed by the thermal head 31. The printed part of the roll sheet 3A is discharged with the printed surface facing downward onto the tray 6 through between the top cover 5 and the housing 2. The part of the roll sheet 3A discharged onto the tray is cut by a cutter unit 8 when the user moves the cut lever 9 rightward.

A schematic structure of the roll sheet holder 3 is explained below with reference to FIGS. 8 through 12.

As shown in FIG. 8 through 12, the roll sheet holder 3 is constructed of the guide member 20, the holding member 12, and a holder shaft 40 of a substantially tube shape. The guide member 20 has a first cylindrical part 35 which is fitted in one open end of the sheet core 3B of the roll sheet 3A so that the guide member 20 is held in contact with one of the end faces of the roll sheet 3A. The holding member 12 has a second cylindrical part 37 which is fitted in the other open end of the sheet core 3B so that the holding member 12 is held in contact with the other end face of the roll sheet 3A. The holder shaft 40 has two open ends 40*a* and 40*b*; the one end 40*a* is fitted in the first cylindrical part 35 of the guide member 20 and formed with a radially extended flange part 36 fixed onto the outer surface of the guide member 20 and the other end 40*b* is fixedly fitted in the second cylindrical part 37 of the holding member 12. The holder shaft 40 may be selected from among a plurality of shafts of different lengths to easily provide many kinds of roll sheet holders 3 holding roll sheets 3A of different widths.

The guide member 20 further includes a first, second, third, and fourth extended portions 42, 43, 44, and 45. The first extended portion 42 is formed extending downward in a predetermined length from a lower periphery of an outer end face of the first cylindrical part 35. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the roll sheet 3A. The third extended portion 44 is formed continuously extending from the second extended portion 43 up to near the insertion opening 18 (see FIG. 6) and has an upper edge sloped downward to the front end. This third extended portion 44 further has a lower edge (44*a*) extending horizontally, which is held in contact with the flat portion 21 of the label printer 1 so that one side edge of the unwound part of the roll sheet 3A is guided along the inner surfaces of the second and third extended portions 43 and 44 up to the insertion opening 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the placing portion 21, a front edge (45*a*) of the fourth extended portion 45 is inserted in appropriate one of the second placing grooves 22A to 22D corresponding to the sheet width of the roll sheet 3A set in the sheet holder 3 (see FIG. 7).

The guide member 20 is further formed with slits 47 of a substantially rectangular shape in side view of the guide member 20, at an upper end of the first extended portion 42, i.e., at diametrical opposed positions of the periphery of the outer end face of the first cylindrical part 35. In these slits 47, protrusions 48 formed on the inner surface of the flange part 36 of the holder shaft 40 are engaged for positioning. In the guide member 20, scales 43A, 43B, and 43C are provided in concentric circular lines on the inner surfaces of the extended portions 43, 44, and 45. These scales 43A to 43C indicate the winding lengths of the roll sheet 3A; 10 m, 20 m, and 30 m. In the present embodiment, the maximum winding length of the roll sheet 3A set in the roll sheet holder 3 is about 30 m.

The holder shaft 40 is provided with a slit 51 in the end portion fitted in the second cylindrical part 37 of the holding member 12. The slit 51 has a predetermined length along the longitudinal direction of the shaft 40 to engage a rib 50 formed protruding radially inward from the inner lower end of the second cylindrical part 37. Such engagement between the rib 50 of the holding member 12 and the slit 51 of the holder shaft 40 makes it possible to correctly position the holding member 12 and the guide member 20 with respect to each other through the holder shaft 40.

The first and second cylindrical parts 35 and 37 serve to rotatably support the sheet core 3B of the roll sheet 3A. The holder shaft 40 may be selected from among a plurality of shafts (four shafts in the first embodiment) of different lengths individually corresponding to the lengths of the sheet cores 3B (i.e., the widths of the roll sheets 3A).

The outer open end of the second cylindrical part 37 is closed by the positioning member 12. A flange 55 is formed around the second cylindrical part 37. An extended portion 56 is continuously formed under the flange 55. Respective inner surfaces of the flange 55 and the extended portion 56 are held in contact with the end face of the roll sheet 3A and the sheet core 3B. On the outer surfaces of the flange 55 and the extended portion 56, the longitudinal mounting piece (positioning rib) 13 is provided protruding outward, at substantially the center of the width of the positioning member 12 in the feeding direction (a lateral direction in FIG. 10A). This mounting piece 13 is of a substantially rectangular section and has a vertical length in a direction substantially perpendicular to the central axis of the holder shaft 40 and a width which becomes smaller in a downward direction so that the mounting piece 13 is fitted in the first positioning groove 16 having a narrower width (in the feeding direction) towards the bottom of the holder support member 15 in the label printer 1.

The protruding distance of the mounting piece 13 is determined to be almost equal to the width (in a direction of the width of the label printer 1, perpendicular to the feeding direction) of the first positioning groove 16.

The mounting piece 13 of the positioning member 12 is provided, on the lower outer surface, with a guide portion 57 of a square flat plate (about 1.5 mm to 3.0 mm in thickness in the first embodiment) having a larger width than the lower portion of the mounting piece 13 by a predetermined amount (about 1.5 mm to 3.0 mm in the first embodiment) at each side of the lower portion. Accordingly, to mount the roll sheet holder 3 in the tape printer 1, the user inserts the mounting piece 13 from above into the first positioning groove 16 by bringing an inner surface of the guide portion 57 into sliding contact with the outer surface of the holder support member 15. Thus, the roll sheet holder 3 can easily be fitted in place.

Figure 8A:
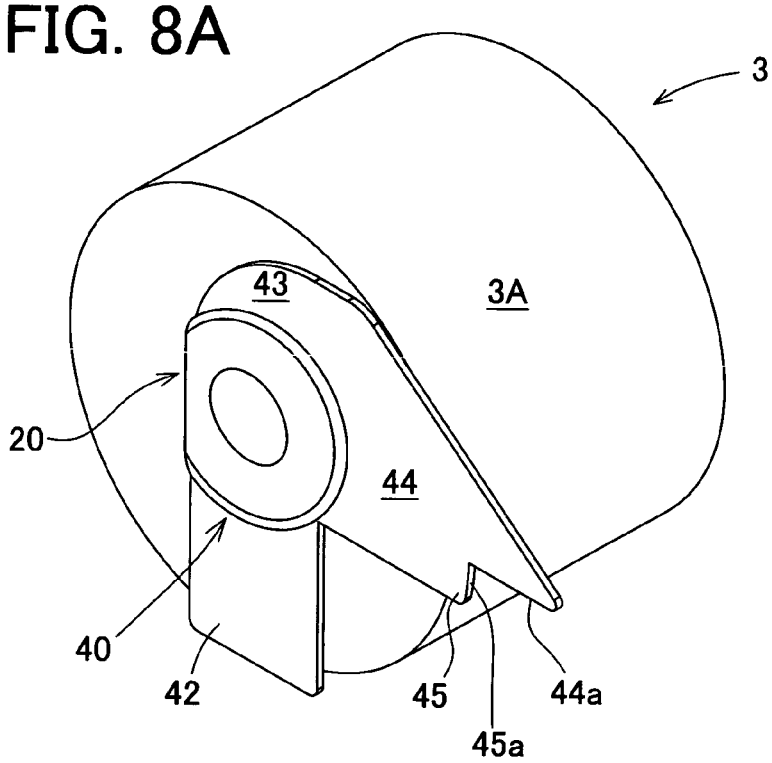
FIG. 8A is a perspective view of a roll sheet holder holding a roll sheet, seen from an obliquely front direction.
Figure 8B:
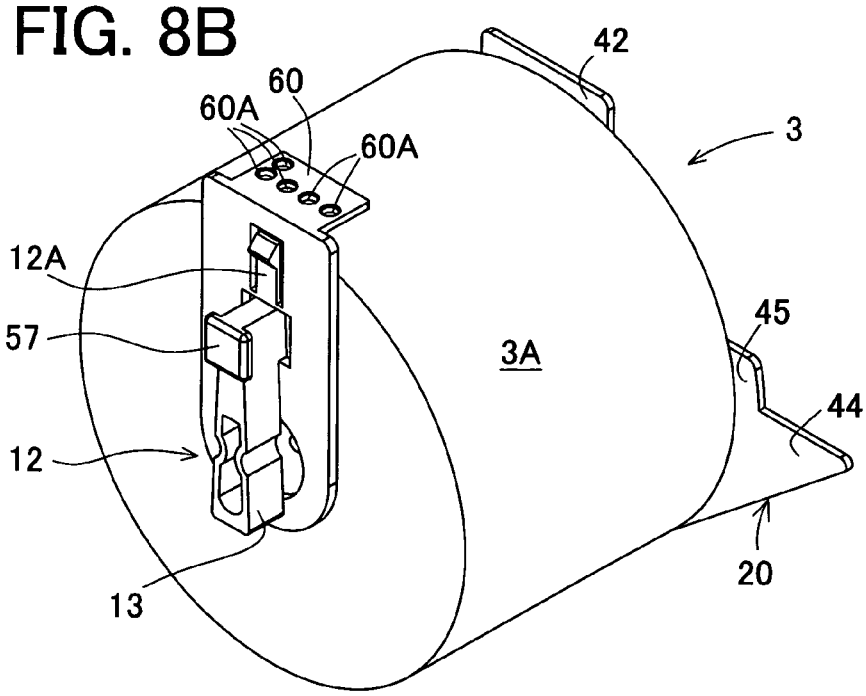
FIG. 8B is a perspective view of the roll sheet holder turned upside down, seen from an obliquely front direction.

The positioning member 12 is designed to have the extended portion 56 extending downward longer by a predetermined length (about 1.0 mm to 2.5 mm in the first embodiment) than the lower end (the first extended portion 42) of the guide member 20. The positioning member 12 is also provided, at the lower end of the extended portion 56, with a sheet discrimination part 60 of a substantially rectangular shape extending inward by a predetermined length at almost right angle to the extended portion 56. As mentioned above, the sheet discrimination part 60 is formed with the sensor holes 60A arranged at predetermined positions corresponding to the sheet discrimination sensors S1 to S5 respectively. As shown in FIG. 8B, five sensor holes 60A are formed at predetermined positions corresponding to the kind of roll sheet 3A held in the sheet holder 3.

Further, the positioning member 12 is further formed with a longitudinally rectangular through hole 62 in the extended portion 56 under the mounting piece 13. The elastic locking piece 12A is provided extending downward from the upper edge of the through hole 62 and formed with an outward protrusion at a lower end.

Figure 13B:
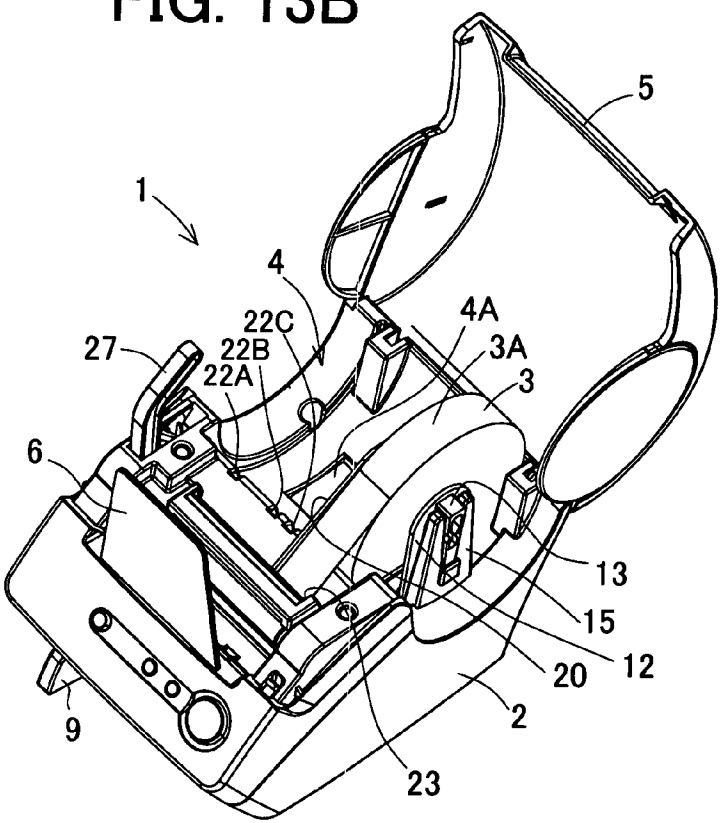
FIG. 13B is a perspective view of the label printer in the first embodiment, in which the roll sheet holder for a minimum roll sheet width is mounted.
Figure 13A:
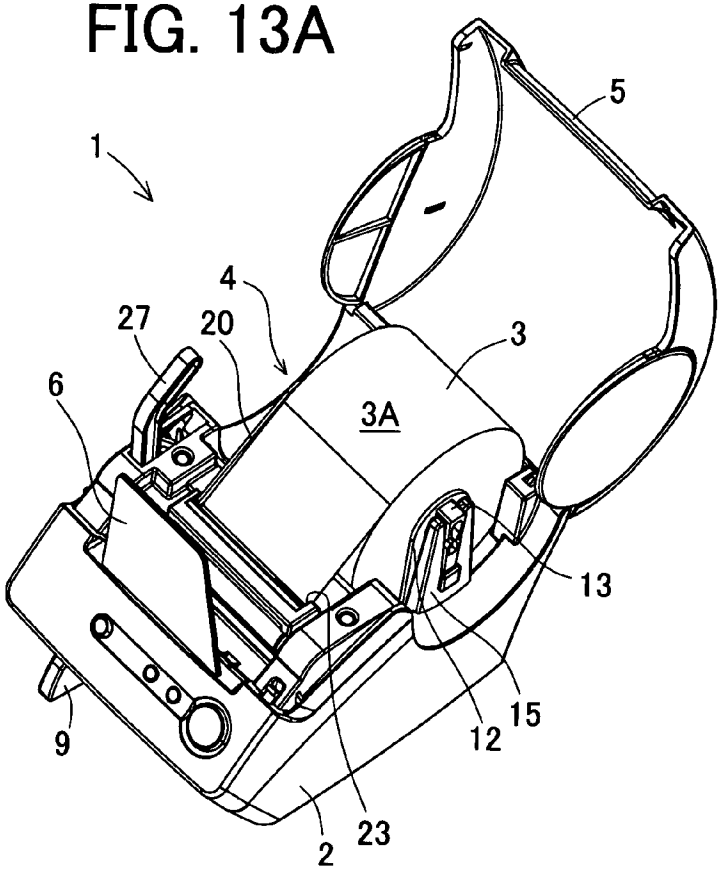
FIG. 13A is a perspective view of the label printer in the first embodiment, in which the roll sheet holder for a maximum roll sheet width is mounted.

An explanation is given to a mounting manner of the roll sheet holder 3 constructed as above in the tape printer 1, referring to FIGS. 13A and 13B.

FIG. 13A shows the case where the roll sheet 3A holds a roll sheet 3A of a maximum width wound on a hollow cylindrical sheet core 3B. The mounting piece 13 of the holding member 12 of the holder 3 is first inserted from above into the positioning groove 16 of the holder support member 15.

The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom. Subsequently, the user turns the lever 27 upward and then draws (unwinds) part of the roll sheet 3A and inserts the leading end of the unwound part of the roll sheet 3A in the insertion opening 18 while guiding one side edge of the unwound part of the roll sheet 3A in contact with the inner surface of the guide member 20 and the other side edge in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

FIG. 13B shows the case where the roll sheet holder 3 holds a roll sheet 3A of a minimum width wound on a hollow cylindrical sheet core 3B. The mounting piece 13 of the holding member 12 of the holder 3 is first inserted from above into the positioning groove 16 of the holder support member 15. The sheet holder 3 is put so that the lower edge 44*a* of the third extended portion 44 of the guide member 20 is brought into contact with the flat portion 21. The fourth extended portion 45 is engaged in the second positioning groove 22D formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

Subsequently, the user turns the lever 27 up and then draws (unwinds) part of the roll sheet 3A to insert the leading end of the unwound part of the roll sheet 3A in the insertion opening 18 while guiding one side edge of the unwound part of the roll sheet 3A in contact with the inner surface of the guide member 20 and the other side edge in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

Figure 14:
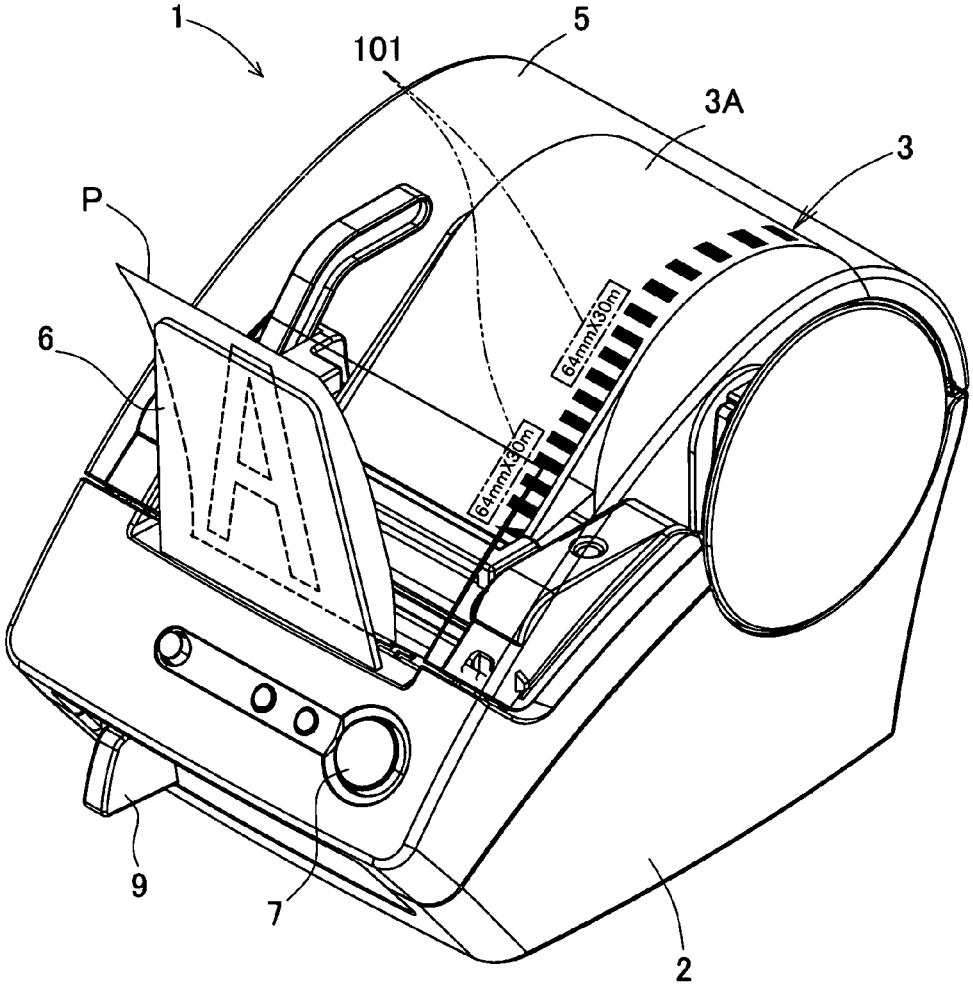
FIG. 14 is a perspective external view of a label printer in one example of the present embodiment, in which the roll sheet holder is mounted.

The following explanation is made on the external appearance of the label printer 1 in the present embodiment. FIG. 14 is a perspective view of the label printer 1 in which the roll sheet holder 3 is mounted. As shown in FIG. 14, the top cover 5 made of transparent resin is attached to the rear upper edge of the housing 2 of the label printer 1 so as to cover the holder storage part 4. The top cover 5 is freely opened and closed. Accordingly, the roll sheet 3A of the roll sheet holder 3 removably set in the holder storage part 4 is visible from outside through the top cover 5.

The roll sheet 3A of the roll sheet holder 3 is provided with a plurality of medium information marks 101 periodically printed in the longitudinal direction. Each mark 101 in the present embodiment is represented as "64 mm×30 m", indicating that the associated roll sheet holder 3 is "64 mm" in width and "30 m" in length. One or more information marks can also be seen from outside through the transparent resinous top cover 5.

Further, the part of the roll sheet 3A discharged through a clearance between the housing 2 and the top cover 5 is laid on the tray 6. When the cut lever 9 is moved rightward, the discharged part of the roll sheet 3A is cut by the cutter unit 8, producing a printed label P. As shown in FIG. 14, for example, the character "A" printed on the printed surface of the printed label P is visible through the tray 6. This is because the printed label P discharged with the "A"-printed surface facing downward is allowed to slide on the tray 6 standing vertically at an angle of 60° with respect to the placing plane where the label printer 1 is placed and also the tray is made of transparent resin.

To achieve the above posture of the discharged part of the roll sheet 3A, the tray 6 has only to be provided vertically at a predetermined angle in a range of 60° to 90° with respect to the placing plane of the label printer 1. This structure allows the printed label to slide on the tray 6 into a raised state, in which the character "A" printed on the printed surface of the printed label P is visible.

Figure 15:
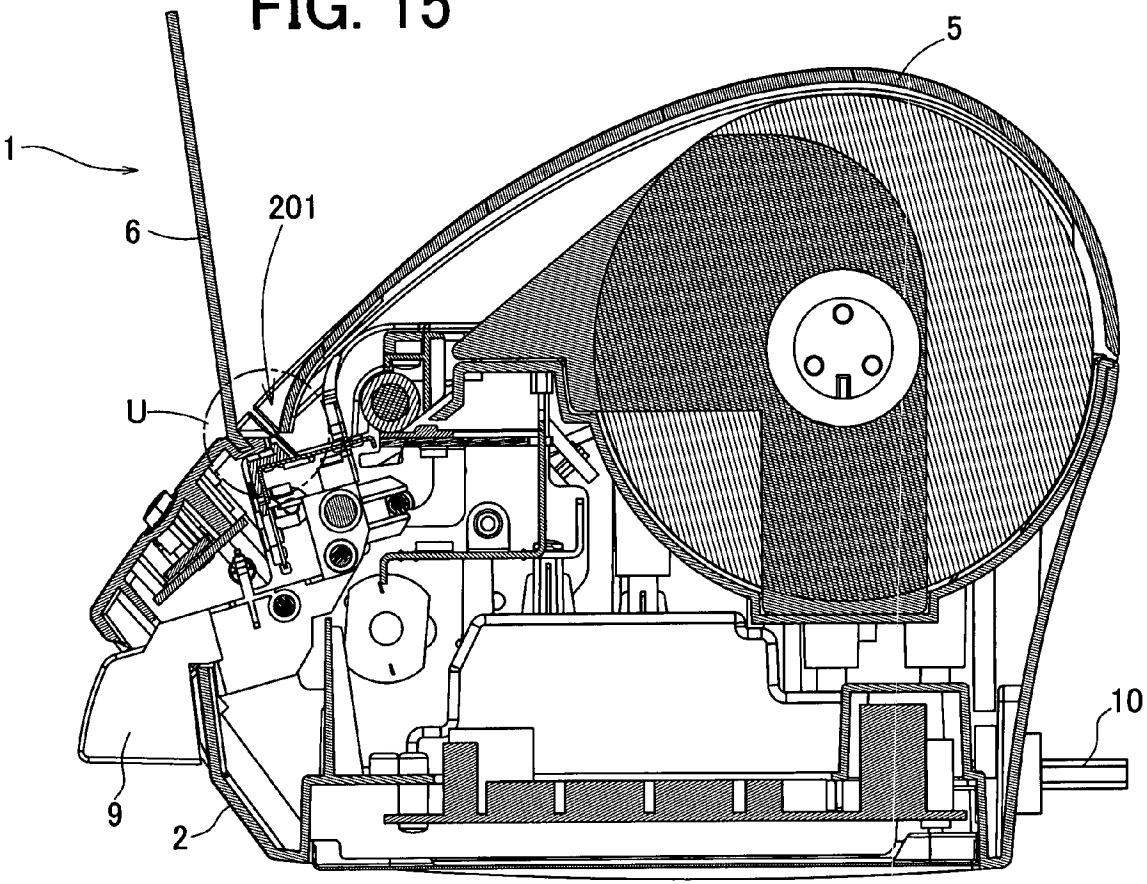
FIG. 15 is a sectional view of the label printer in the present embodiment, in which the roll sheet holder is mounted.

As a sectional view of FIG. 15, the top cover 5 attached to be freely opened and closed to the housing 2 is formed with a recess 201 in an end facing to the tray 6. This recess 201 is made in consideration with that when the printed labels P are continuously produced, they are stacked one on top of another on the vertically positioned tray 6 and the stacked printed labels P are likely to slide onto the top cover 5. Even when a plurality of printed labels P are produced consecutively, those printed labels P can be stacked on the tray 6 by the recess 201 as shown in FIG. 16 which is a partially sectional enlarged view of a circled part in FIG. 15.

Figure 16:
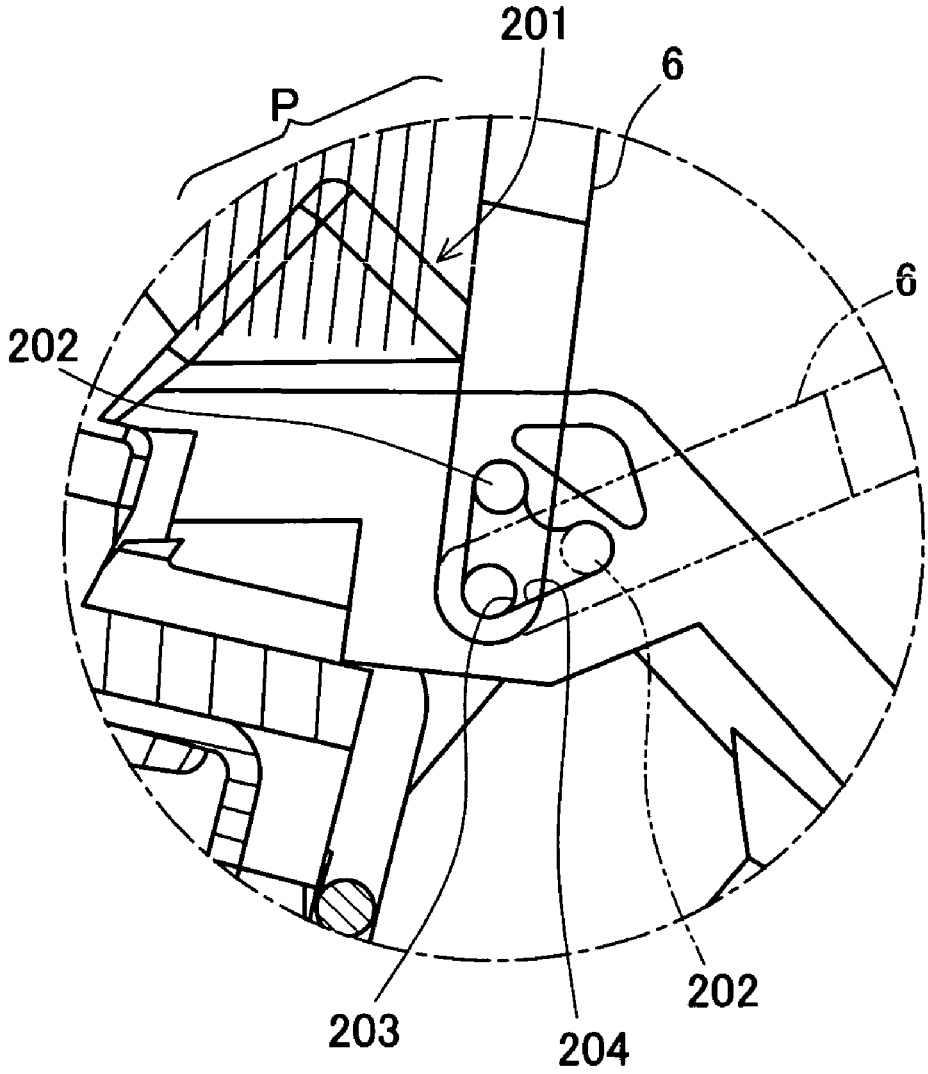
FIG. 16 is a partially enlarged sectional view of a circled part U in FIG. 15.

As shown in FIG. 16, furthermore, a pair of protrusions 202 and 203 formed in the tray 6 at a side end are engaged in a locking hole 204 formed in the housing 2, thereby holding the tray 6 in a standing position. The locking hole 204 includes three engageable parts so that the angle of the tray 6 with respect to the housing 2 can be changed according to at which part the protrusion 202 of the tray 6 is engaged in the locking hole 204. In FIG. 16, the angle of the tray 6 is adjustable between two angles.

The tray 6 may be configured to be adjustable at a desired angle among two or more angles. In this case, a user is permitted to adjust the angle of the tray 6 to a desired angle at which the printed surface of the printed label P on the tray 6 is easily visible to the user.

The tray 6 may also be structured to have an adjustable angle in a range of 60° to 90° with respect to the placing plane of the label printer 1 and to be turnable into a horizontal position parallel to the placing plane. In this case, a user is allowed to adjust the angle of the tray 6 to a desired angle in a range of 60° to 90° so that the user can easily see the printed surface of the printed label P on the tray 6. In addition, when the tray 6 is turned to the horizontal position, the printed label P is easy to remove in case of jamming.

As explained in detail as above, the label printer 1 in the present embodiment, as shown in FIG. 14, the top cover 5 is attached to be freely opened and closed to the rear upper edge of the housing 2 provided with the transparent resinous tray 6 in a standing position and the printed label P is discharged with the printed surface downward through the clearance between the housing 2 and the top cover 5. At this time, the printed label P is allowed to slide on the tray 6 so that the printed surface (on which the character "A" is printed in FIG. 14) is in contact with the tray 6. The printed label P is thus moved into a vertical position where the printed surface is visible. Consequently, the user can see the printed surface of the printed label P discharged with the printed surface downward. In this regard, the tray 6 in a standing position with respect to the housing 2 can bring the printed surface of the printed label P into a visible state. This structure can be realized by a low cost molding without needing a special space and a complicated structure for the tray 6. Accordingly, a label printer in the present embodiment can be achieved without growing in size, and becoming complicated in structure and high-cost printer.

The printed labels P discharged onto the tray 6 are stacked one on top of another toward the top cover 5. At this time, the recess 201 of the top cover 5, provided adjacent to the tray 6 as shown in FIG. 16, can serve to receive a number of printed labels P stacked on the tray 6.

In the label printer 1 in the present embodiment, the locking hole 204 of the housing 2 and the pair of protrusions 202 and 203 provided at the side end of the tray 6 constitute a mechanism for removably mounting the tray 6 to the housing 2 at a standing angle which is changeable in two steps. With this mechanism, the angle of the tray 6 can be changed such that the tray 6 is set in for example a horizontal position parallel to the placing plane of the label printer 1 indicated by a chain double-dashed line in FIG. 3 in case of jamming of the printed label P when discharged through the clearance between the housing 2 and the top cover 5 or stacked on the tray 6.

In the label printer 1 in the present embodiment, the transparent resinous tray 6 is used as a "guide member" as shown in FIG. 13 to bring the printed label P having the printed surface on which the character "A" is printed into a vertical position. Alternatively, a transparent plate-shaped_member or a bent wire may be used to bring the printed label P into the vertical position. In these cases, similarly, the printed surface of the printed label P discharged with the printed surface downward can be seen. Further, a label printer in the present embodiment can be achieved without growing in size, and becoming complicated in structure and high-cost printer.

In the label printer in the present embodiment, as shown in FIG. 14, the medium information mark 101, "64 mm×30 m", indicating that the associated roll sheet holder 3 is "64 mm" in width and "30 m" in length is printed continuously on a release sheet over its length, the release sheet being bonded on one side of the thermal sheet of the roll sheet 3A with an adhesive. Further, the roll sheet 3A is in a wound state around the sheet core 3B with the thermal sheet being inside as mentioned above. Accordingly, the release sheet bonded on the one side of the thermal sheet with an adhesive is outside with respect to the sheet core 3B. Thus, one or more marks 101 can be seen constantly through the transparent resinous top cover 5 as shown in FIG. 17 even where the remaining amount of the roll sheet 3A becomes small.

When the remaining amount of the roll sheet 3A of the roll sheet holder 3 becomes small, the second extended portion 43 of the guide member 20 comes into view. Then, the scales 43A and 43B indicating 10 m and 20 m of the winding lengths of the roll sheet 3A can be seen through the top cover 5.

Figure 9B:
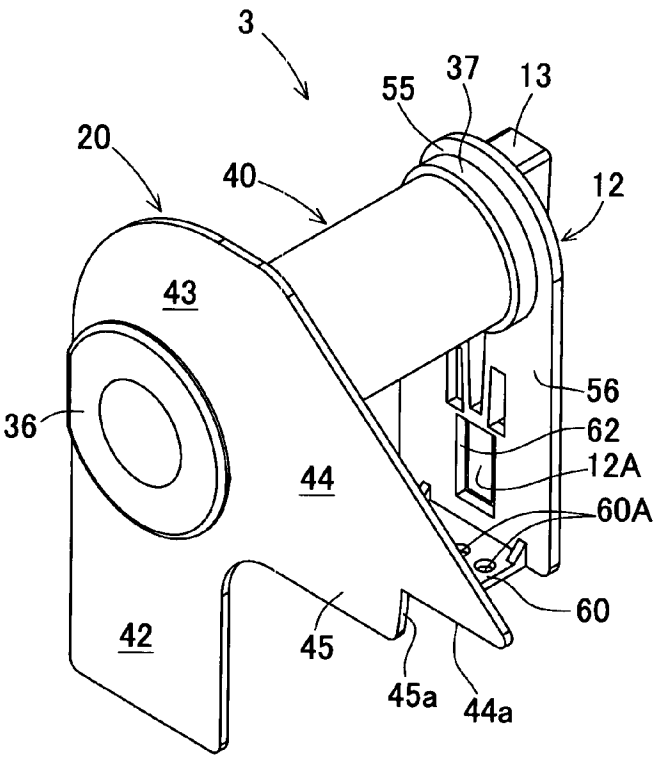
FIG. 9B is a perspective view of the roll sheet holder alone seen from an obliquely front direction.
Figure 9A:
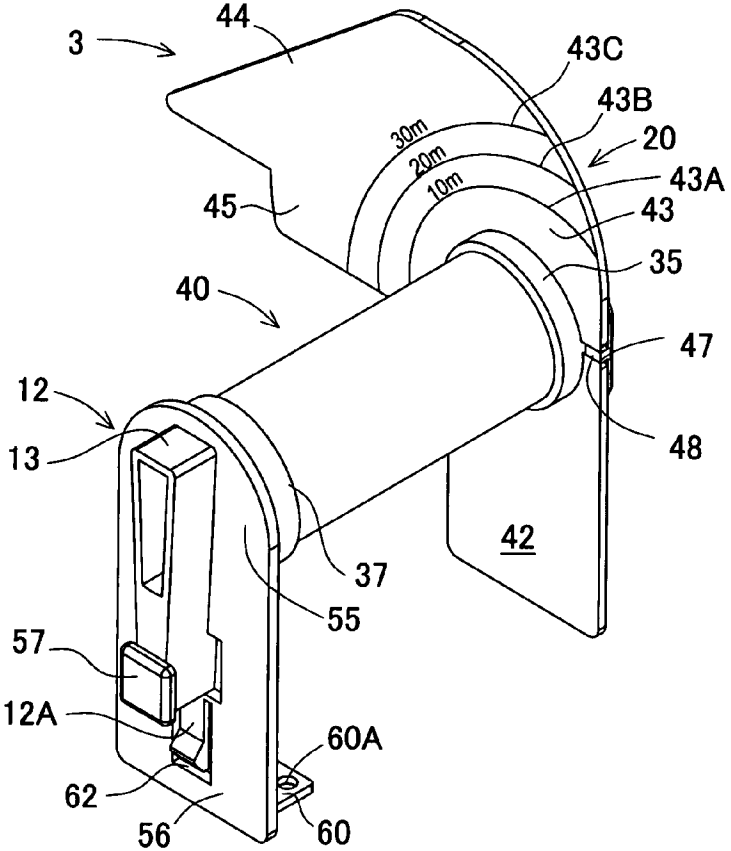
FIG. 9A is a perspective view of the roll sheet holder alone seen from an obliquely back direction.
Figure 17:
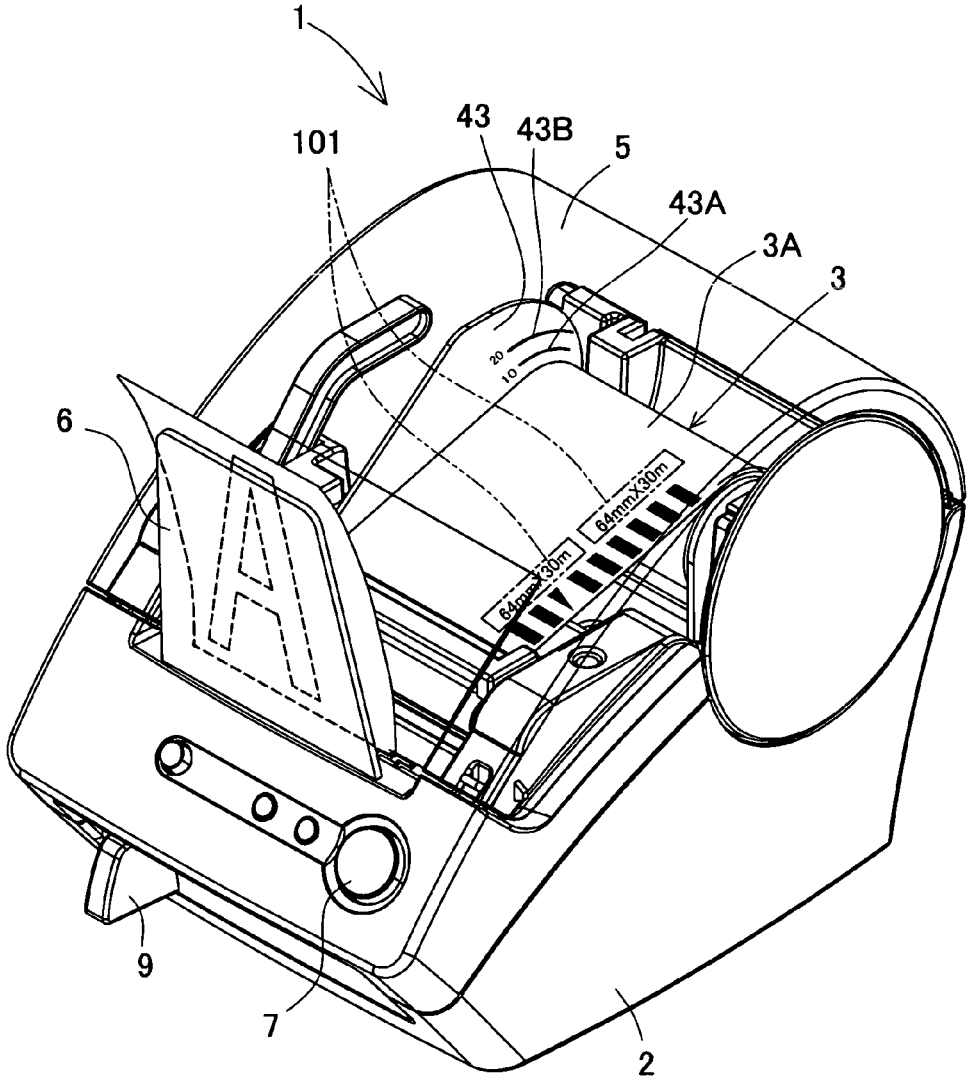
FIG. 17 is a perspective external view of the label printer of FIG. 14, in which the remaining amount of a roll sheet is small.

FIG. 17 shows another example of a roll sheet holder 3, which is provided with scales 43A and 43B different from those in FIG. 9A.

The roll sheet holder 3 in the present embodiment holds the roll sheet 3A wound around the sheet core 3B into a rolled state. In this view, the medium information marks 101 are provided previously to the release sheet bonded on the back of the thermal sheet of the roll sheet 3A, so that the marks 101 appear outside.

In the label printer 1 in the present embodiment, the roll sheet holder 3 is mounted in the holder storage part 4 of the housing 2. At this time, the roll sheet holder 3 is covered by the top cover 5 attached to be freely opened and closed to the housing 2.

The top cover 5 covering the roll sheet holder 3 is made of transparent resin in at least a curved upper part as shown in FIGS. 14 and 17. The medium information marks 101 appearing on the outside is visible through the top cover 5. Accordingly, the label printer 1 and the roll sheet holder 3 in the present embodiment allow a user to see the medium information marks 101 from outside even when the roll sheet holder 3 is mounted in the label printer 1.

In the label printer 1 in the present embodiment, furthermore, the first positioning groove 16 is formed in the holder support member 15 vertically provided in the holder storage part 4 at a side end. In this groove 16, the mounting piece 13 provided in a protruding state on the outer end face of the flange 55 and the extended portion 56 of the roll sheet holder 3 is inserted. The roll sheet holder 3 can thus be positioned in place without fail based on one side end of the holder storage part 4. This makes it possible to place each of the roll sheets 3A of different widths in a correct position.

Consequently, in any cases where the roll sheet holder 3 holding one of the roll sheets 3A of different widths is mounted in the label printer 1, the end face side of the roll sheet 3A of the roll sheet holder 3 is surely positioned adjacent to the side end of the storage part 4 as shown in FIGS. 13A and 13B.

The roll sheet 3A of the roll sheet holder 3 is previously provided with the medium information marks 101 by printing in the edge portion to be positioned adjacent to the one side end of the holder storage part 4 serving as a reference position as shown in FIGS. 14 and 17.

Even when the roll sheet holder 3 holding one of the roll sheets 3A of different widths is mounted in the label printer 1, the edge portion of the roll sheet 3A of the roll sheet holder 3 is positioned adjacent to the one side end of the holder storage part 4. In the edge portion of the roll sheet 3A, therefore, printed medium information marks 101 exist. Accordingly, the position of the medium information marks 101 is within a given area regardless of the sheet width, so that the marks 101 are easy to see from outside.

Figure 18:
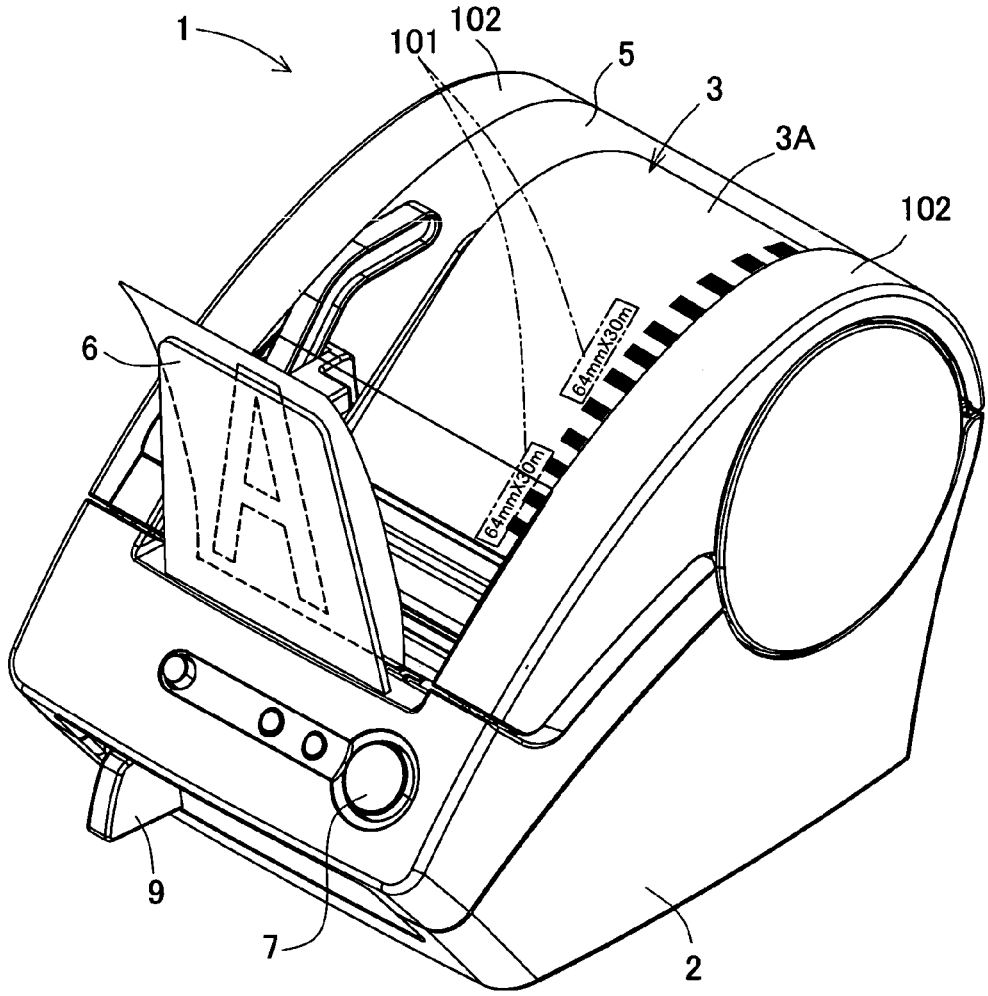
FIG. 18 is a perspective external view of a label printer in another example of the present embodiment, in which the roll sheet holder is mounted.

In light of above, the top cover 5 does not have to be made of transparent resin except for the top part covering the fixed area where the marks 101 appear. Even in this case, the marks 101 are surely visible from outside. For example, in FIG. 18, the curved top part of the top cover 5 includes side parts 102 made of opaque resin positioned on both sides of a transparent center part. The mechanisms placed on both sides of the roll sheet holder 3 are hidden from view by the opaque side parts 102. This provides a clean appearance to the label printer 1.

The above explanation is made on the medium information marks 101 previously printed on the roll sheet 3A in the edge portion in the longitudinal direction. The same is applied to information codes printed below the medium information marks 101 (see FIGS. 14, 17, and 18).

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A label printer in combination with a printing medium, comprising:

a housing in which the printing medium is mounted so that one edge of the printing medium is aligned with one side of the housing, the printing medium having a printing surface and a back surface on which a medium information mark is previously printed, and the printing medium being wound so that the printing surface is inside and the medium information mark appears outside; and a top cover placed over the housing, the top cover being entirely or partially made of a transparent material so that the medium information mark is visible therethrough, wherein the medium information mark includes user-readable identification information of the printing medium, the user-readable information including at least one alphabetic character, the user-readable information including at least a width and a length of the printing medium.

2. The label printer according to claim 1, wherein a printed label is discharged with a printed surface facing downward through a clearance between the housing and the top cover;

the label printer further includes a guide member vertically provided in the housing for receiving the printed label which is discharged while sliding on the guide member, with the printed surface being in contact with the guide member, into a vertical state where the printed surface is visible.

3. The label printer according to claim 2, wherein the guide member is a transparent tray.

4. The label printer according to claim 3, further comprising a removably mounting mechanism for changing an angle of the guide member disposed in a standing position.

5. The label printer according to claim 3, wherein the top cover is provided with a recess adjacent to the tray.

6. The label printer according to claim 2, further comprising a removably mounting mechanism for changing an angle of the guide member disposed in a standing position.

7. The label printer according to claim 6, further comprising a removably mounting mechanism for changing an angle of the guide member disposed in a standing position.

8. A printing medium, the printing medium being mountable in a label printer, the printer medium including:

a printing surface; and a back surface on which a medium information mark is previously printed;

wherein the printing medium is wound so that the printing surface is inside and the medium information mark appears outside, wherein the medium information mark includes user-readable identification information of the printing medium, the user-readable information including at least one alphabetic character, the user-readable information including at least a width and a length of the print medium, wherein when the printing medium is mounted in a label printer, a housing in which the printing medium is mounted so that one edge of the printing medium is aligned with one side of the housing, and a top cover is placed over the housing, the top cover being entirely or partially made of a transparent material so that the medium information mark is visible therethrough.

9. The printing medium according to claim 8, wherein the medium information mark is provided in an edge portion adjacent to the one side of the housing of the label printer.

10. The printing medium according to claim 9, including a plurality of printing media of different widths, wherein each printing medium is provided with the medium information mark at a constant position of the edge portion adjacent to the one side of the housing.

11. The printing medium according to claim 9, wherein the medium information mark includes a plurality of medium information marks that are printed continuously on the printing medium in a longitudinal direction thereof so that one or more of the plurality of medium information marks are visible through the top cover.

12. The printing medium according to claim 10, wherein the medium information mark includes a plurality of medium information marks that are printed continuously on the printing medium in a longitudinal direction thereof so that one or more of the plurality of medium information marks are visible through the top cover.

* * * * *